US006817877B1

(12) United States Patent
Agabekov et al.

(10) Patent No.: US 6,817,877 B1
(45) Date of Patent: Nov. 16, 2004

(54) POWER SUPPLY RAIL FOR SUPPLYING ELECTRIC POWER TO CURRENT CONSUMING ELEMENTS OF VARYING DIMENSIONS

(76) Inventors: Ladislav Agabekov, 73, Route de Thonon, Vesenaz - Geneva (CH), CH-1222; Ivan Agabekov, 14, Boulevard George-Favon, Geneva (CH), CH-1204

( * ) Notice: Subject to any disclaimer, the term of this patent is extended or adjusted under 35 U.S.C. 154(b) by 0 days.

(21) Appl. No.: 10/296,607

(22) PCT Filed: May 22, 2000

(86) PCT No.: PCT/CH00/00287

§ 371 (c)(1),
(2), (4) Date: Nov. 21, 2002

(87) PCT Pub. No.: WO01/90635

PCT Pub. Date: Nov. 29, 2001

(51) Int. Cl.[7] ..... H01R 4/60

(52) U.S. Cl. ..... 439/207; 439/235; 439/299; 439/698; 362/219

(58) Field of Search ..... 439/207, 208, 439/234, 235, 239, 110, 226; 362/219

(56) References Cited

U.S. PATENT DOCUMENTS 4,482,944 A 11/1984 Roossine et al.
4,569,568 A * 2/1986 Agabekov ..... 439/638
4,979,081 A * 12/1990 Leach et al. ..... 362/219
5,041,953 A 8/1991 Dannatt

FOREIGN PATENT DOCUMENTS

| | | |
|---|---|---|
| DE | 9101723 | 5/1991 |
| EP | 0126023 | 11/1984 |
| GB | 2015800 | 9/1979 |
| WO | 92/14966 | 9/1992 |

OTHER PUBLICATIONS

International Search Report of PCT/CH00/00287 dated Jan. 15, 2001.

* cited by examiner

*Primary Examiner*—Tho D. Ta
(74) *Attorney, Agent, or Firm*—Ostrolenk, Faber, Gerb & Soffen, LLP

(57) ABSTRACT

The invention concerns a power supply rail consisting of a profiled section (30) comprising two legs each for receiving a conducting strip (10, 20) provided with contacts at regular intervals. The invention also concerns a method for making a such a rail, which consists in: simultaneously sliding two conducting strips along the legs of the profiled section; determining the spacing A between the electrical contacts (12) of the first strip and those (22) of the second strip, depending on the dimensions of the current consuming elements used; and in fastening the conducting strips into the profiled section.

21 Claims, 1 Drawing Sheet

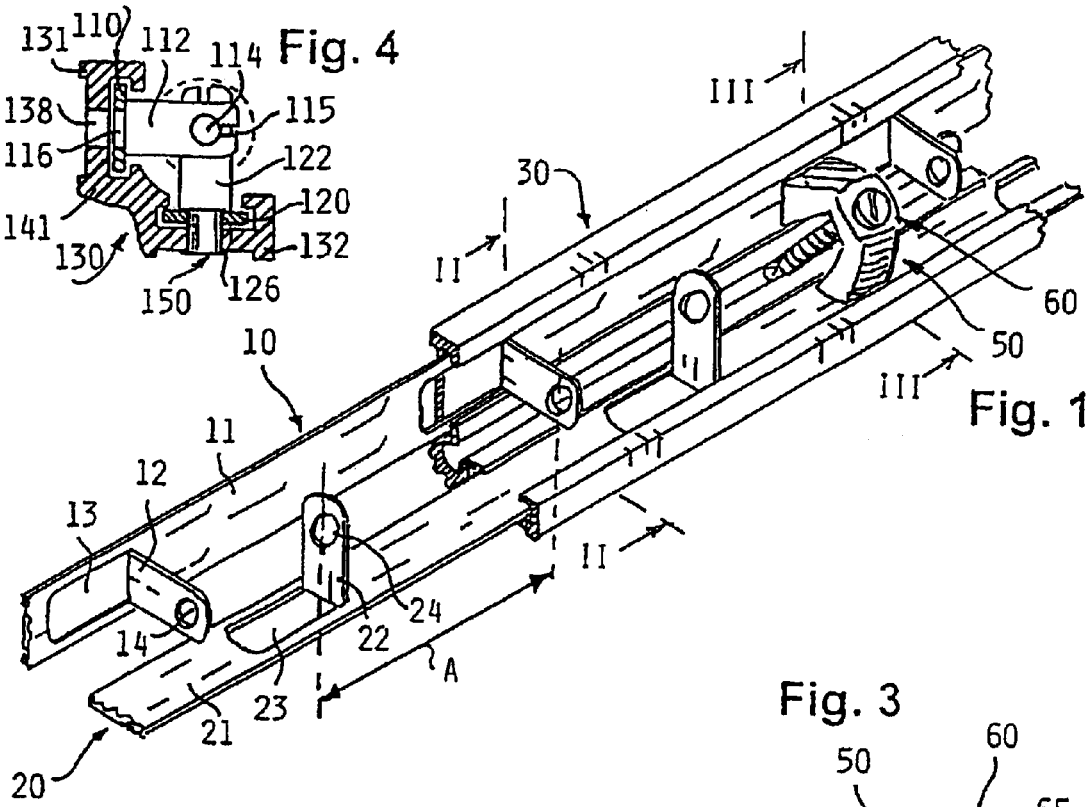
Fig. 4
Fig. 1
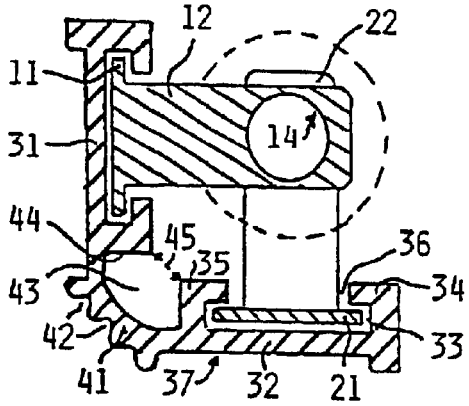
Fig. 2
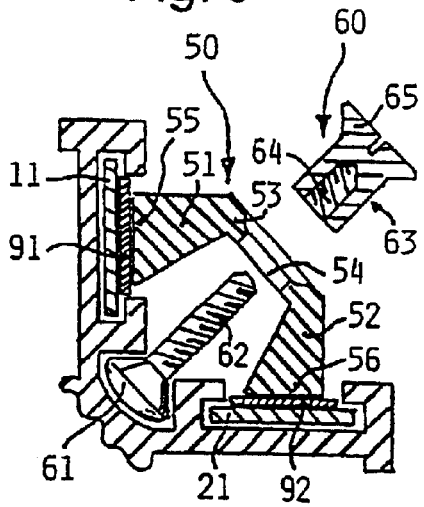
Fig. 3
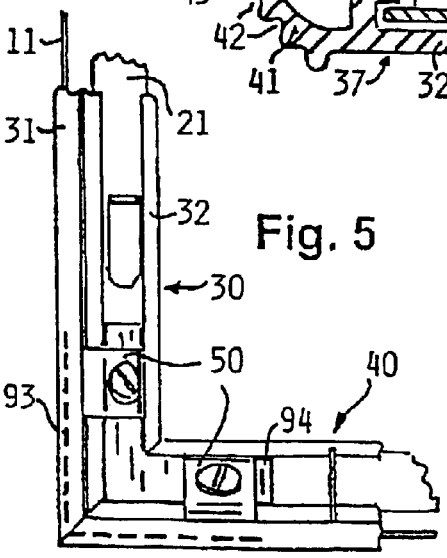
Fig. 5
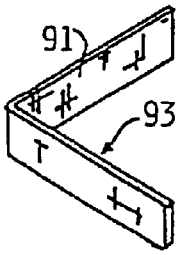
Fig. 6
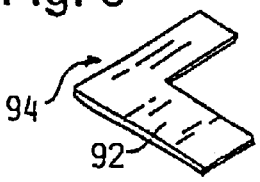
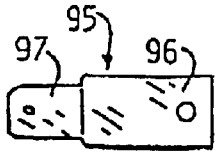
Fig. 7

POWER SUPPLY RAIL FOR SUPPLYING ELECTRIC POWER TO CURRENT CONSUMING ELEMENTS OF VARYING DIMENSIONS

The present invention relates to the field of lighting systems and more particularly relates to a power supply rail.

FIELD OF THE INVENTION

For many years, power supply rails comprising a profiled section which receives conducting strips supplying electrical contacts for receiving series of current consuming elements placed between two adjacent contacts, for example, shuttle type bulbs or soffit bulbs, have been available on the market.

BACKGROUND OF THE INVENTION

The applicant has already developed rails of this type described in European patent EP-0 126 023 which relates to a system where the profiled section has two perpendicular legs comprising slots at regular interval for the passage of contacts projecting from conducting strips applied to the back of the legs of the profiled section. The spacing between the contact pairs for receiving the lamps is fixed during construction by the position of the slots made in the legs of the profiled section. The result of this is that it is necessary either to produce different types of rail depending on the length standards of the shuttle bulbs, or to use U-shaped clips making it possible to electrically connect the contacts projecting from the conducting strips to the connecting poles of the lamps used.

SUMMARY OF THE INVENTION

The present invention aims to alleviate this drawback. Its subject is a supply rail consisting of a profiled section formed by two legs capable of receiving two conducting strips, each one provided at regular intervals with electrical contacts for supplying current consuming elements placed between two adjacent contacts connected to alternate conducting strips.

The invention is characterized in that the profiled section comprises channels capable of receiving and positioning said conducting strips, the spacing between the electrical contacts of the first strip and the contacts of the second strip being positioned, using means for fastening the strips into the profiled section, depending on the dimension of the current consuming elements.

The invention also extends to a method of manufacturing a power supply rail consisting of a profiled section comprising two legs, each one intended to receive a conducting strip provided with electrical contacts at regular intervals, characterized in that two conducting strips are simultaneously slid along the legs of the profiled section, the spacing between the electrical contacts of the first strip and those of the second strip is determined depending on the dimensions of the current consuming elements used, and the conducting strips are fastened into the profiled section.

In a first embodiment, the means for fastening the strips in the profiled section consist of a V-shaped shoe capable of cooperating with the strips and of clamping means capable of cooperating with the profiled section. Furthermore, these fastening means may hold electrical connection plates between the wires supplying the rail and the conducting strips, and connection elements between two profiled sections placed end to end or forming any angle between them.

In a variant, the profiled section is made of metal, especially of aluminum. The outer surfaces of the profiled section may be provided with an insulating coating.

According to another variant, the profiled section is made of aluminum and the conducting strips are provided with an insulating coating.

In a second embodiment, comprising an insulating profiled section, the conducting strips are directly screwed or riveted to each leg of the profiled section.

The appended drawing shows, by way of nonlimiting examples, certain embodiments of the subject of the present invention.

BRIEF DESCRIPTION OF THE DRAWINGS

FIG. 1 is a perspective view of a rail in the process of assembly, when the conducting strips are slid into their supporting profiled section.

FIG. 2 is a cross section, on an enlarged scale, of the rail of FIG. 1, at the position of a contact tongue along line II—II.

FIG. 3 is a cross section, also on an enlarged scale, along line III—III in FIG. 1, showing a way of fastening conducting strips to the profiled section into which they are slid.

FIG. 4 is a cross section showing a variant for fastening conducting strips placed in a profiled section made of an insulator.

FIG. 5 is a top view of an assembly comprising two rails placed at a right angle.

FIG. 6 shows, seen in perspective, the plates—one in the form of a right angle and one in the form of an L—forming the elements for joining the two rails of FIG. 5.

FIG. 7 is a top view of one of the plates supplying the rail.

DETAILED DESCRIPTION

The multipurpose rail according to the invention comprises a first conducting strip 10 consisting of a metal strip 11 which is provided, at regular intervals, with contact tongues 12 arranged at 90°. In the variant shown, each tongue 12 is obtained by cutting and folding which leaves behind a series of cutouts 13 in the metal strip 11. At its free end, each contact tongue 12 comprises a circular opening 14 for receiving the end of a shuttle bulb or of any other current consuming element.

A second conducting strip 20 comprises, in a similar manner, contact tongues 22 leaving cutouts 23 in a metal strip 21 and each one having a circular opening 24 for cooperating with the current consuming element.

The metal strips are coated with an insulating layer applied over their entire outer surface except for the free ends of the tongues 12 and 22, since the circular openings 14 and 24 must establish contact with the lamps to be powered.

The conducting strips 10 and 20 are slid into a profiled section 30 with two symmetrical legs where they can be fastened by means of a fastening shoe 50 and clamping means 60. Before fastening the conducting strips 10 and 20, the spacing A between the contact tongues of each of the strips will be adjusted, depending on the dimensions of the bulbs expected to be used.

The profiled section 30 will be described in more detail with respect to the cross section shown in FIG. 2. It comprises two symmetrical legs 31 and 32, each one provided on its inner face with a central recess 33 for receiving one of the metal strips 11 or 21. The recess 33 is partially closed from above by an outer overhang 34 and an inner overhang 35 between which there is a passage 36 wide enough to allow the free passage of the tongues 12 and 22.

On its outer face, each of the legs 31 or 32 comprises a hollow 37 for receiving a self-adhesive strip not shown in the drawing, allowing the assembly to be fastened in its final position. The central part 41 of the profiled section comprises, towards the outside, fluting 42 to increase the surface area for heat loss. Towards the inside, the presence of a central channel 43 between the sides 44 bordering the inner overhangs 35 will be noted. Care will be taken to make a passage 45, the usefulness of which will be explained below.

In a preferred variant, the profiled section 30 is made of aluminum. To prevent any contact with the conducting strips 10 and 20, the profiled section will be covered with an insulating coating. This embodiment has the advantage that there is no danger of deformation due to heat, which makes it possible to mount more powerful bulbs.

In the examples shown in the drawing, the legs 31 and 32 are perpendicular, but they can be placed in another angular arrangement without departing from the scope of the present invention. The important point is to give the conducting strips 10 and 20 and the profiled section 30 dimensions such that the circular openings 14 and 24 are aligned along a common axis, corresponding to the central axis of the cylindrical bulbs to be supplied, shown by a dotted line in FIG. 2.

The surfaces of the overhangs 34 and 35 directed toward the bulbs will advantageously have smooth surfaces, so as to reflect the light emitted by the bulbs.

For clarity of the drawing, the contact tongues 12 and 22 are no longer shown in the cross section of FIG. 3, which is taken through a fastening shoe 50 and its clamping means 60.

More specifically, the insulating shoe 50 comprises two supports 51 and 52, connected by a central bridge 53 which has an opening 54 for the passage of the clamping means 60. The bases 55 and 56 of the supports are designed to cooperate, at least indirectly, with the metal strips 11 and 21.

The clamping means 60 consist of a screw, the head 61 of which is designed to slide with clearance along the central channel 43 provided in the bend of the profiled section 30 and the threaded shank 62 of which is placed substantially in the center of the shoe 50 and is designed to pass with clearance through the passage 45 separating the inner overhangs 35. The clamping means also comprise a counterpiece 63 having a tapped opening 64 intended to press against the opening 54 of the shoe 50.

The assembly consisting of the shoe 50 and its clamping means 60 make it possible to set the relative position of the conducting strips 11 and 21 with respect to the profiled section after adjusting the distance A between the tongues 22 and 12 depending on the type of bulb used. Furthermore, this assembly 50, 60 may also serve to fasten plates supplying the conducting strips and/or to fasten elements joining two rails according to the invention.

Thus FIG. 3 also shows two plates 91 and 92 which represent either the elements joining two adjacent rails, whether the latter are placed end to end or form an angle as shown in FIG. 5, or the plates supplying the conducting strips 11 and 21, as will be mentioned below.

In the embodiment of FIG. 4, a variant embodiment is shown comprising a profiled section 130 made of plastic in which the strips 111 and 121 are fastened by rivets 150, one of which is shown in section in the drawing. In this version, the profiled section 130 comprises a central part 141 between two legs 131 and 132, each of which, as described above, has a central recess 33 for receiving one of the metal strips 111 or 121 comprising, at regular intervals, contact tongues 112 and 122 respectively, the free end of each tongue having a circular opening 114 extended towards the outside by a passage 115 for facilitating the insertion of the bulb.

In this second embodiment, after having slid the strips 111 and 121 along the legs 131 and 132 of the profiled section 130 and placed the tongues 112 and 122 at the desired distance A, the profiled section 130 and the conducting strips 111 and 121 are drilled in order to produce holes 138 in the legs 131 and 132, together with holes 116 and 126 in the strips 111 and 121, into which holes are inserted rivets 150 or any other equivalent locking means, for example screwing, adhesive bonding means or the like. For clarity of the drawing, only one rivet 150 is shown so that the holes 138 in the leg 131 and 116 in the strip 111 are visible.

As has already been mentioned, it is often necessary to connect the lighting rails described thus far. To obtain the arrangement of FIG. 5, profiled sections 30 and 40 cut at 45° are used, and two shoes 50, the supports 51 of which cooperate with the components of the legs 31 of the profiled section while the supports 52 cooperate with those of the legs 32, are placed at the ends of the profiled sections. In this case, the joining elements consist of a plate 93 folded at right angles and a flat L-shaped plate 94, which are shown in perspective in FIG. 6 and the cross section of which constitutes the elements 91 and 92 shown in FIG. 3.

Finally, it is possible to use the assemblies 50 and 60 in order to supply power to the metal strips 11 and 21. For this purpose, it is possible to use a plate 95 as shown in FIG. 7, which comprises a flat part 96 intended to be clamped against the metal strip 11 or 21 to be supplied, while the narrow part 97 is designed to receive a power supply clip welded to a conductor in a conventional manner. It goes without saying that the embodiment shown in FIG. 4 also allows the connection between two power supply rails.

As mentioned above, the profiled sections 30 and the means of locking the strips 50, 60, 150 may be made of metal, for example aluminum. As with the conducting strips 10, 20, the profiled sections may be provided with an insulating coating.

The invention as described is particularly suitable for obtaining very great lengths of power supply rails. The simplicity of assembly makes it possible to slide strips measuring several meters into metal or plastic profiled sections, obtained in standard lengths of a few meters.

What is claimed is:

1. A power supply rail for providing electric power to at least one current consuming element, the power supply rail comprising:

first and second conducting strips having respective electrical contacts for supplying the electric power to the current consuming element placed between the electrical contacts of the first and second conducting strips;

a profiled section having two legs arranged substantially perpendicular to one another, the legs having respective channels for receiving the first and second conducting strips, respectively, the channels being configured to permit the conductive strips to be selectively positioned so that a spacing between the electrical contacts of the first and second conducting strips may be adjusted to accommodate current consuming elements of varying dimensions; and a fastening arrangement for fixing a position of the conductive strips within the channels of the legs of the profiled sections.

2. The power supply rail as claimed in claim 1, wherein the fastening arrangement includes spots of adhesive.

3. The power supply rail as claimed in claim 1, wherein the legs of the profiled section include respective holes, the conducting strips include respective holes, and the fastening arrangement includes rivets passing through the holes of the legs and the holes of the conducting strips the position of the conductive strips within the channels of the legs of the profiled sections.

4. The power supply rail as claimed in claim 1, wherein the profiled section is made of plastic.

5. The power supply rail as claimed in claim 1, further comprising insulating layers respectively covering the conducting strips for electrically insulating portions of the conducting strips.

6. The power supply rail as claimed in claim 1, wherein the fastening arrangement includes a V-shaped shoe configured to cooperate with the conductive strips, and includes a clamping arrangement configured to clamp the V-shaped shoe against the conducting strips for fixing the position of the conductive strips within the channels of the legs of the profiled sections.

7. The power supply rail as claimed in claim 1, further comprising power supply plates held in position by the fastening arrangement, the power supply plates being configured to couple with power supply wires for providing the electric power to the current consuming element via the conductive strips.

8. A power supply rail comprising a plurality of profiled sections as claimed in claim 1, and at least one connecting plate held in position by the fastening arrangement, the connecting plate configured to adjust a relative positioning of the profiled sections.

9. The power supply rail of claim 1, wherein each of the first and second conductive strips includes a plurality of electrical contacts provided at regular intervals for accommodating a plurality of current consuming elements.

10. The power supply rail of claim 1, wherein the channels for receiving the conducting strips are arranged on respective sides of the legs of the profiled section facing the current consuming element.

11. The power supply rail as claimed in claim 1, wherein the profiled section is made of aluminum.

12. The power supply rail as claimed in claim 11, further comprising an insulating layer covering the profiled section for electrically insulating the profiled section.

13. A method of manufacturing a power supply rail for providing electric power to at least one current consuming element, the method comprising:

sliding first and second conducting strips into respective channels of a profiled section having two legs arranged substantially perpendicular to one another, the conducting strips having respective electrical contacts for supplying the electric power to the current consuming element placed between the electrical contacts of the first and second conducting strips;

selectively positioning the conductive strips within the channels so that a spacing between the electrical contacts of the first and second conducting strips may be adjusted to accommodate dimensions of the current consuming element, the channels of the profiled section being configured to permit the conductive strips to be selectively positioned so that a spacing between the electrical contacts of the first and second conducting strips may be adjusted to accommodate current consuming elements of varying dimensions; and fixing a position of the conductive strips within the channels of the profiled using a fastening arrangement.

14. The method as claimed in claim 13, wherein the fastening arrangement includes spots of adhesive.

15. The method as claimed in claim 13, further comprising providing the conductive strips with respective insulating layers to electrically insulate portions of the conducting strips.

16. The method as claimed in claim 13, further comprising providing power supply plates held in position by the fastening arrangement, the power supply plates being configured to couple with power supply wires for providing the electric power to the current consuming element via the conductive strips.

17. The method as claimed in claim 13, wherein the legs of the profiled section include respective holes, the conducting strips include respective holes, and the fastening arrangement includes rivets passing through the holes of the legs and the holes of the conducting strips the position of the conductive strips within the channels of the legs of the profiled sections.

18. The method as claimed in claim 17, wherein the profiled section is made of plastic.

19. The method as claimed in claim 17, wherein the fastening arrangement includes a V-shaped shoe configured to cooperate with the conductive strips, and includes a clamping arrangement configured to clamp the V-shaped shoe against the conducting strips for fixing the position of the conductive strips within the channels of the legs of the profiled sections.

20. The method as claimed in claim 17, wherein the profiled section is made of aluminum.

21. The method as claimed in claim 20, further comprising providing the profiled section with an insulating layer to electrically insulate the profiled section.

* * * * *